US007139405B1

(12) United States Patent
Grattan et al.

(10) Patent No.: US 7,139,405 B1
(45) Date of Patent: Nov. 21, 2006

(54) HEADSET WITH SPRING LOADED MICROPHONE

(75) Inventors: Alan W. Grattan, Santa Cruz, CA (US); Benjamin D. Gannon, Los Gatos, CA (US)

(73) Assignee: Plantronics,Inc., Santa Cruz, CA (US)

( * ) Notice: Subject to any disclaimer, the term of this patent is extended or adjusted under 35 U.S.C. 154(b) by 342 days.

(21) Appl. No.: 10/810,085

(22) Filed: Mar. 26, 2004

(51) Int. Cl.
*H04R 25/00* (2006.01)
*H04R 1/02* (2006.01)

(52) U.S. Cl. ..... 381/375; 381/380; 381/395

(58) Field of Classification Search ..... 379/420.03, 379/430, 438; 381/370, 371, 374, 375, 376, 381/378, 379, 380, 383, 384, 394, 395
See application file for complete search history.

(56) References Cited

U.S. PATENT DOCUMENTS

2002/0090099 A1* 7/2002 Hwang ..... 381/322
2002/0181729 A1* 12/2002 Smith ..... 381/384

* cited by examiner

*Primary Examiner*—Sinh Tran
*Assistant Examiner*—Brian Ensey
(74) *Attorney, Agent, or Firm*—Thomas Chuang

(57) ABSTRACT

The present invention provides a communications headset. The communications headset includes an earbud with a speaker to be disposed near the ear of a headset user, a microphone, and an electrical connector designed to couple with a communications device. An electrical cord is coupled between the earbud and the electrical connector. A spring cord is coupled between the earbud and the microphone. The microphone is capable of bidirectional movement with associated extension and retraction of the spring cord.

16 Claims, 5 Drawing Sheets

HEADSET WITH SPRING LOADED MICROPHONE

TECHNICAL FIELD

The present invention relates to the general field of telecommunications devices. More specifically the invention relates to headset design.

BACKGROUND

Headsets and other portable communications devices are often designed to be easily stored during non-operation so that the headset can be transported along with a mobile telephone device. In the prior art, headsets often employ an earbud with a speaker and a microphone coupled to a cord which dangles down from the user's ear during operation. This boomless headset design allows for convenient storage, often employing an integrated cord retractor to wind the headset cord during non-operation.

Headset cords are often bulky, cumbersome and difficult to store when excessively long. The headset cords often become entangled during headset stowage, exposing them to damage. The entangled cords must be unentangled prior to operation. This is undesirable to consumers, who generally prefer compact telecommunication devices and accessories.

Integrated cord retractors only wind the headset cord between the headset plug interface and the dangling microphone. The length of cord between the earbud and the dangling microphone is not wound due to the coupling of the microphone to the cord. Referring to FIG. 1, a prior art headset configuration is illustrated. An earbud 100 is coupled to a microphone 102 via a length of electrical cord 104. Microphone 102 is fixed to electrical cord 104, and as a result, the length of electrical cord 104 between earbud 100 and microphone 102 is fixed. A cord retractor 106 is utilized to wind the length of the electrical cord 104 between microphone 102 and connector 108.

The unwound length of cord 104 is exposed to potential damage and inconvenient tangling during transportation of headset. In one typical solution, the length of unwound cord is shortened by coupling the microphone to the cord closer to the earbud. However, this solution introduces the potential for insufficient isolation of a voice signal during operation, resulting in echo. Furthermore, during operation of the headset users frequently position the microphone closer to their mouth with their hand to improve the signal to noise ratio of the voice signal. By shortening the length of unwound cord, there may be insufficient length to position the microphone in front of the user mouth as desired.

Thus, improved headset designs are needed that provide both performance and portability.

SUMMARY OF THE INVENTION

The present invention provides a solution to the needs described above through an inventive headset with a spring loaded microphone.

The present invention provides a communications headset. The communications headset includes an earbud with a speaker to be disposed near the ear of a headset user, a microphone, and an electrical connector designed to couple with a communications device. An electrical cord is coupled between the earbud and the electrical connector. A spring cord is coupled between the earbud and the microphone. The microphone is capable of bi-directional movement with associated extension and retraction of the spring cord.

The present invention further provides a communications headset. The communications headset includes an earbud with a speaker to be disposed near the ear of a headset user, a microphone, and an electrical connector designed to couple with a communications device. An electrical cord is coupled between the earbud and the electrical connector. A spring cord is coupled between the earbud and the microphone, and the electrical cord is disposed within the coils of the spring cord. The relative position of the microphone along the electrical cord defines a plurality of microphone positions. The microphone positions include a storage position associated with the spring cord in a retracted status, a first use position for hands free operation whereby the spring cord is in a first extended position due to the weight of the microphone, and a second use position for improved signal to noise ratio whereby the spring cord is in a second extended position due to user applied force.

The present invention provides a method for improving signal to noise ratio in a communications headset. The communications headset includes an earbud with a speaker to be disposed near the ear of a headset user, a microphone, and an electrical connector designed to couple with a communications device. An electrical cord is coupled between the earbud and the electrical connector. A spring cord is coupled between the earbud and the microphone, and the electrical cord is disposed within the coils of the spring cord. The microphone is positioned along the electrical cord away from the earbud with a user applied force, wherein signal to noise ratio is improved. The microphone is automatically retracted along the electrical cord towards the earbud upon termination of the user applied force. The spring cord provides the retraction force to position the microphone for hands free operation.

DESCRIPTION OF THE DRAWINGS

The features and advantages of the apparatus and method of the present invention will be apparent from the following description in which.

DETAILED DESCRIPTION OF THE PREFERRED EMBODIMENTS

The present invention provides a solution to the needs described above through an inventive headset with spring loaded microphone.

Other embodiments of the present invention will become apparent to those skilled in the art from the following detailed description, wherein is shown and described only the embodiments of the invention by way of illustration of the best modes contemplated for carrying out the invention. As will be realized, the invention is capable of modification in various obvious aspects, all without departing from the spirit and scope of the present invention. Accordingly, the drawings and detailed description are to be regarded as illustrative in nature and not restrictive.

The present disclosure describes a headset with a spring loaded microphone. In the preferred embodiment, the microphone is coupled to a spring cord. The other end of the spring cord is coupled to an earbud. A separate electrical cord is coupled to the earbud and a communications device connector. The electrical cord is disposed within the coils of the spring cord, thereby defining an axis of movement along which the microphone can move up and down relative to the electrical cord. The relative position of the microphone along this axis defines a distance of electrical cord between the microphone and earbud.

The present invention enables the distance of electrical cord between the microphone and earbud to vary during storage and operation through the use of the spring cord attached between the microphone and earbud. During storage, the microphone is in a retracted state associated with a retracted spring cord. During one mode of operation, the microphone is pulled down the length of the electrical cord away from the earbud towards the user's mouth, thereby providing improved signal to noise ratio and isolation from the earbud. Upon release of the microphone by the user, the microphone slides back towards the earbud along the length of electrical cord due to retraction of the spring cord. During a second mode of operation, the communications headset may be used in a hands free mode (also referred to herein as a "hands free dangle mode" or "dangle mode"). The microphone is extended down the length of electrical cord away from the earbud, extending the spring cord due to the weight of the microphone without additional user applied force. The dangle mode improves signal to noise ratio and isolation from the earbud relative to an unextended position.

Figure 1:
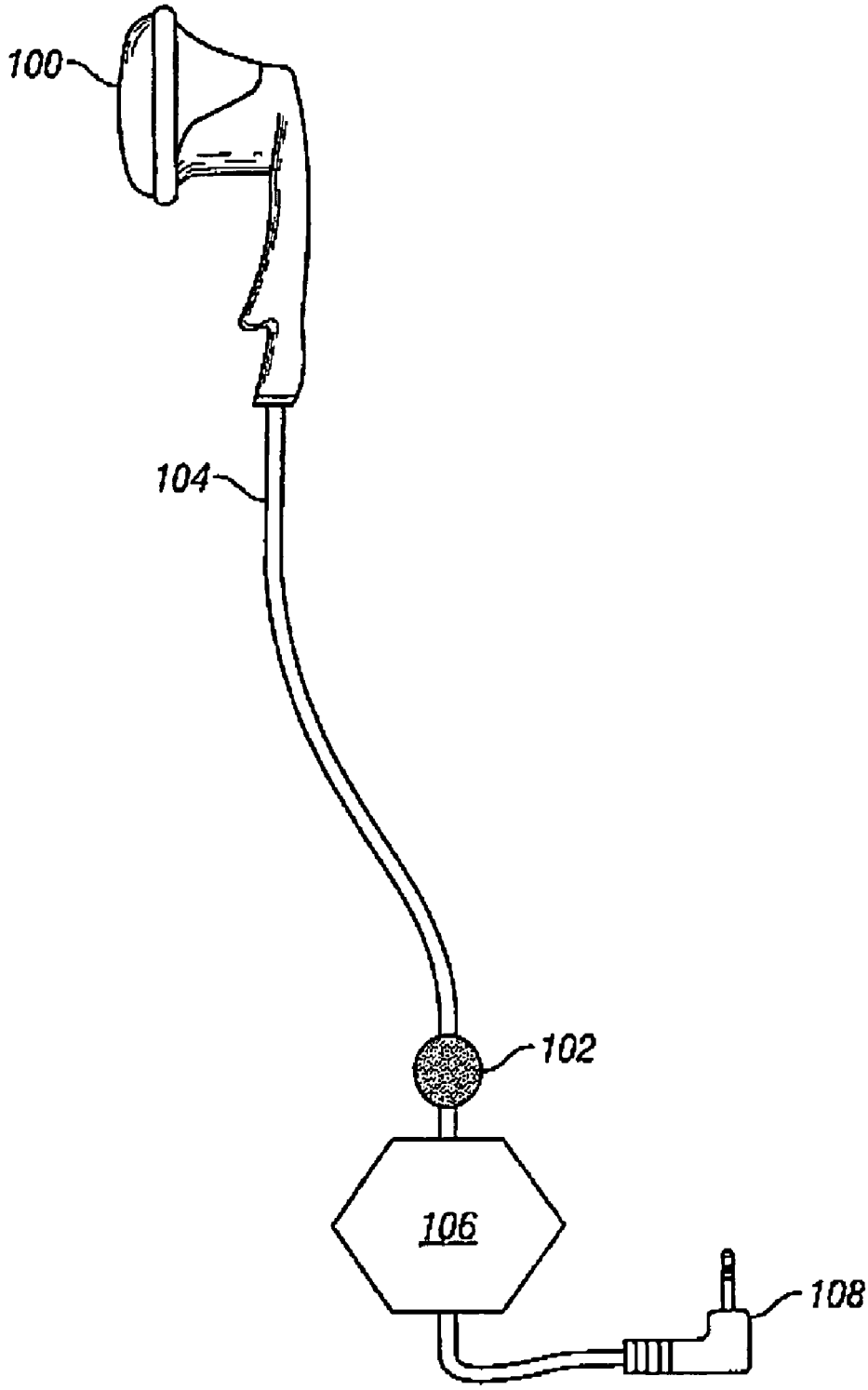
FIG. 1 (Prior Art)
FIG. 1 illustrates a prior art headset configuration.
Figure 2:
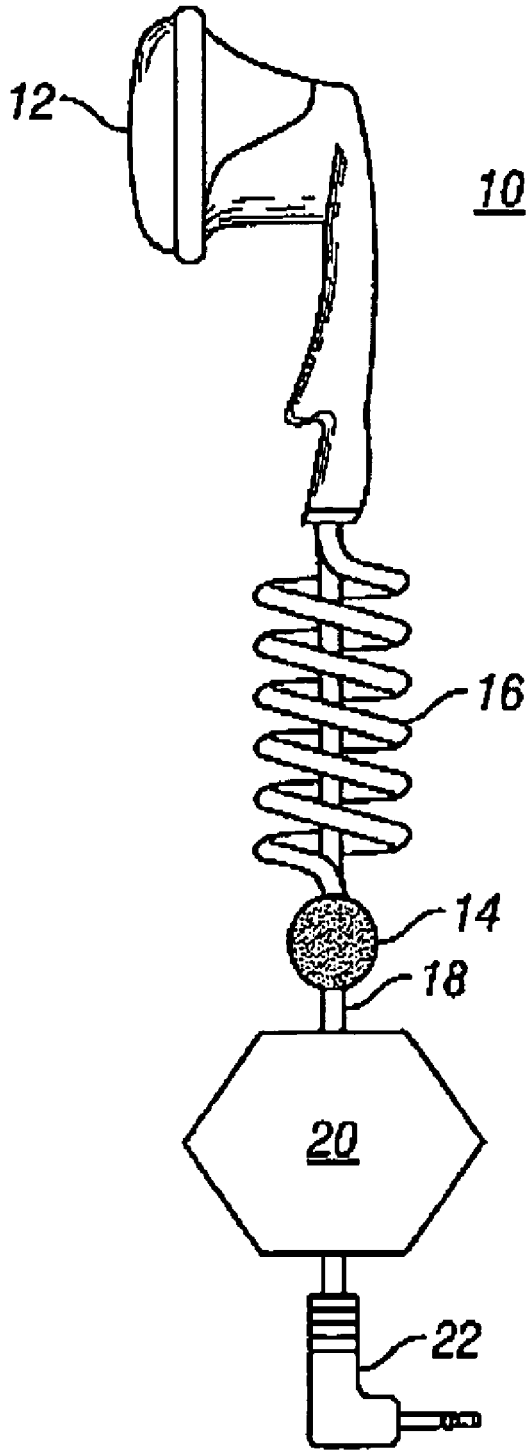
FIG. 2 illustrates a side view of an embodiment of the communications headset of the present invention.

Referring to FIG. 2, a side view illustration of an embodiment of the communications headset is shown. The communications headset assembly 10 is shown in a retracted position for periods of non-use or storage. The communications headset in a dangle and extended position is illustrated and described below. The communications headset assembly 10 includes an earbud 12, microphone assembly 14, cord retractor 20, and connector 22. Earbud 12 is operably associated with the proximately positioned speaker within the earbud to transmit sound to the headset user. A spring cord 16 is physically and electrically coupled between earbud 12 and microphone assembly 14. Electrical cord 18 is physically and electrically coupled between earbud 12 and connector 22. The communications headset assembly 10 is configured so that electrical cord 18 is disposed within the coils of spring cord 16. Connector 22 is a male plug to be inserted into an input/output port disposed on a telecommunications device. While not in use, the connector 22 may be disconnected from the receptacle of the telecommunications device.

Figure 5:
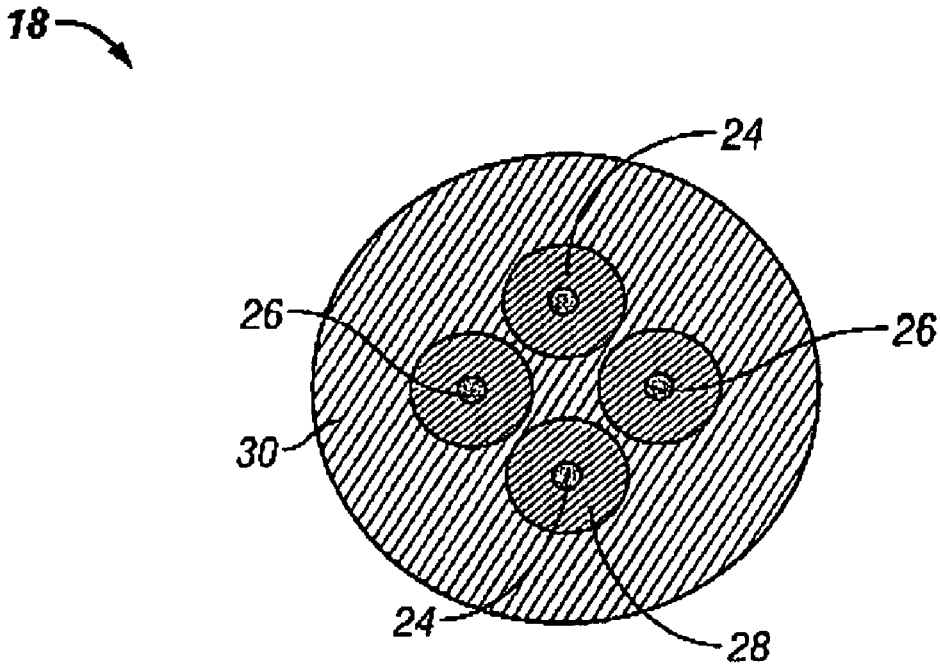
FIG. 5 illustrates a cross-sectional view of an electrical cord between an earbud and a telecommunications device connector.

FIG. 5 is a cross-sectional view of electrical cord 18. Electrical cord 18 includes four conductors forming a first conductor pair 24 and a second conductor pair 26. Each conductor is sheathed within a primary insulation material 28. Primary insulation material 28 is formed from a plastic material, such as polyvinyl chloride (PVC). The two conductor pairs and primary insulation material are encased in an outer jacket 30. Outer jacket 30 is also formed of a plastic material, such as polyurethane or a polyvinyl chloride composition, and also includes a top-coating formed on the outer surface. Conductor pair 24 is terminated at earbud 12, and is coupled to the speaker within earbud 12 to output a voice receive signal from a far-end user. Conductor pair 26 propagates a user voice transmit signal from the headset user to connector 22 as described below.

Figure 6:
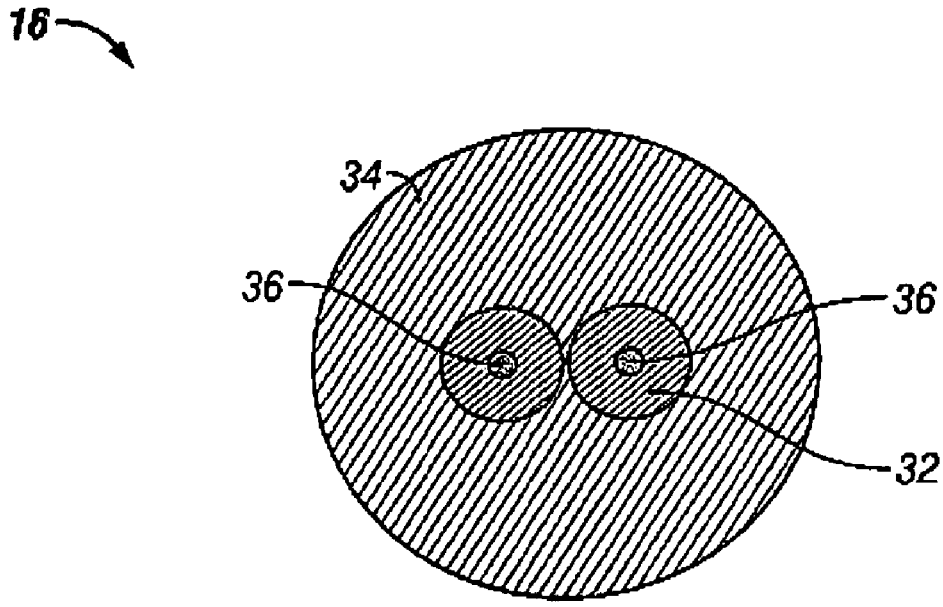
FIG. 6 illustrates a cross-sectional view of a spring cord that is coupled to a microphone in the present invention.

FIG. 6 is a cross-sectional view illustrating spring cord 16 that is coupled between earbud 12 and microphone assembly 14 in the present invention. Spring cord 16 includes two conductors forming a conductor pair 36. Each conductor is sheathed within a primary insulation material 28. The conductors and primary insulation material are encased in an outer jacket 30. Primary insulation material 28 and outer jacket 30 are formed from a flexible plastic material such as polyvinyl chloride or a polyvinyl chloride composition. Spring cord 16 is a spiral wound coiled cable, comprising a series of coils which form loops. Spring cord 16 exhibits extension spring characteristics such that the cord will return to its normal retracted position after having been extended and released.

Spring cord 16 is formed by winding cordage into a group of coils on a mandrel. The coiled cord is passed through a heating zone where it is exposed sufficient heat to soften the jacketing composition in order to impart a helical set to the cord. Following heating, the group of coils is advanced through a cooling zone. The cord is then removed from the mandrel in a manner to reverse the direction of helical wind, thereby improving the spring characteristics of the cord. During the coil process, the ends of the cordage are clamped to the mandrel in a manner so that they are straight in order to facilitation coupling to the microphone assembly 14 and earbud 12. One end of conductor pair 36 is coupled to the microphone assembly 14 to receive user voice transmit communications. The other end of conductor pair 36 is coupled to conductor pair 26 at earbud 12 so that the user voice transmit communications are provided to connector 22 for output.

Earbud 12 is adapted to be fit in a user's ear. Typically, earbud 12 is circularly shaped with an approximate diameter of 10–17 mm. The invention is not limited to the use of earbuds, and other receivers may be employed. The microphone assembly 14 contains a microphone element disposed within the assembly housing. As a result of electrical cord 18 being disposed within spring cord 16, movement of microphone assembly 14 is advantageously limited to up and down movement along an axis defined by electrical cord 18. Undesired flopping of the microphone assembly 14 is thereby limited.

In a further embodiment, the housing of microphone assembly 14 further contains a slider mechanism such as an eyelet configured to receive electrical cord 18. Electrical cord 18 is physically linked to the housing of microphone assembly 14 when inserted through the eyelet. The microphone assembly 14 can slidably advance or retract along electrical cord 18 in response to a user's application of force or in response to retraction by spring cord 16. The microphone assembly housing 14 includes one or more ports for facilitating the passage of sound to the microphone element.

Spring cord 16 is coupled between earbud 12 and microphone assembly 14 in order to spring load microphone assembly 14. Spring cord 16 extends based on movement of the microphone assembly 14. In an embodiment of the invention, spring cord 16 allows downward movement of the microphone assembly 14 either due to gravity or when a user applies force by grasping and pulling the microphone assembly 14. When released by the user, the microphone assembly 14 is retracted along electrical cord 18 towards earbud 12 due to the retraction force exerted by spring cord 16. The relative position of microphone assembly 14 along electrical cord 18 defines a distance of electrical cord 18 between the microphone and earbud.

Spring cord 16 has an initial tension Pi and free length L, which represents the overall length of spring cord 16 in an unloaded position. When the communications headset assembly 10 is in a dangle position, spring cord 16 is loaded by the gravitational force of the coupled microphone, resulting in an initial deflection as a result of such gravitational force. The user's physical hand adjustment provides an active force to the spring cord to cause an additional deflection of the spring cord. Spring cord 16 has sufficient retractability to ensure that it returns to its length prior to extension and release. Furthermore, spring cord 16 is constructed so that the initial tension is sufficiently low so as to not require excessive force to extend the cord, thereby reducing the possibility that the user will dislodge the earbud rather than extend the spring cord when positioning the microphone.

Cord retractor 20 is spring loaded and configured to uptake electrical cord 18. Cord retractor 20 includes a release and return lever which operably allows electrical cord 18 to extend there from or retract back therein. As such, electrical cord 18 is retractable to store in an un-entangled manner and protected from damage. The variable segment of electrical cord 18 extending between the microphone assembly 14 and earbud 12 is not retracted into cord retractor 20. At the end of retractable electrical cord 18 is connector 22.

Referring to FIG. 2, in a retracted position, microphone assembly 14 is positioned in a stop position with the associated distance of electrical cord 18 between microphone assembly 14 and earbud 12 minimized as sliding microphone assembly is pushed towards earbud 12. In an embodiment of the invention, the length of spring cord 16 in the retracted position is the unloaded free length L. The length of electrical cord 18 between microphone assembly 14 and cord retractor 20 is stored in cord retractor 20, as illustrated. In a retracted position, the communications headset assembly 10 is in the smallest form factor for a retractable headset with in line microphone. The retracted position reduces the amount of unretracted cord that is exposed, thereby reducing the chance for damage. During operation, the microphone assembly 14 is movable along the axis defined by electrical cord 18 towards the user's mouth, in both hands-free and hand-operated modes in order to improve signal isolation, echo reduction, and signal to noise ratio.

Figure 3:
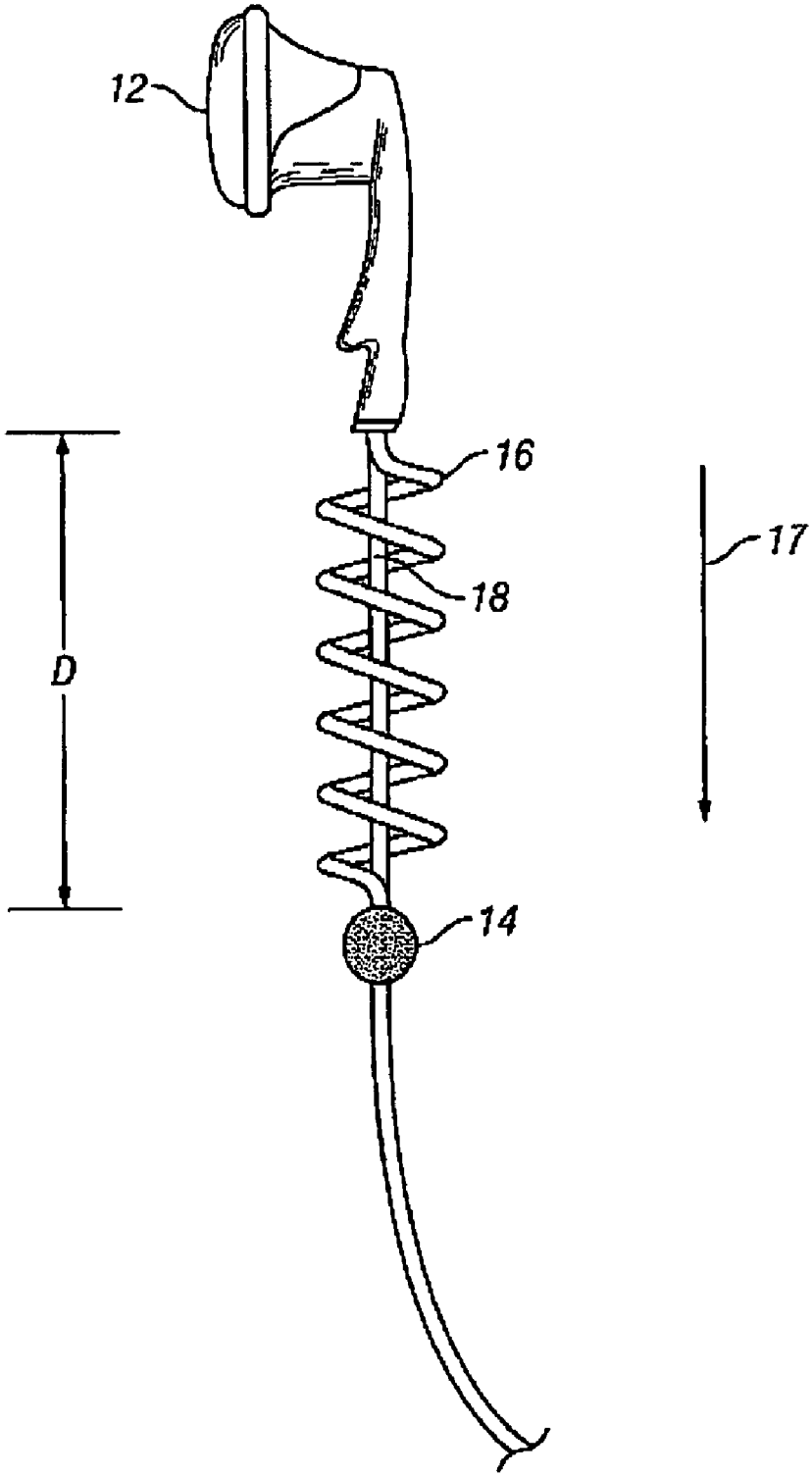
FIG. 3 illustrates a side view of the communications headset of the present invention in a dangle position.

The operation of the communications headset assembly 10 in a hands-free mode will now be described. Referring to FIG. 3, a side view of the communications headset in a dangle position is shown. In the dangle position, cord retractor 20 is released so that electrical cord 18 stored in cord retractor 20 is extracted. In use, the connector 22 is inserted into the corresponding connector on a telecommunications device. Earbud 12 is placed into a user's ear. Microphone assembly 14 is disposed along the length of electrical cord 18 a distance D from earbud 12. Microphone assembly 14 exerts a gravitational force on spring cord 16 in a direction 17, resulting in extension of spring cord 16 and corresponding advancement of microphone assembly 14 down electrical cord 18. Direction 17 is defined by an axis corresponding to electrical cord 18. Movement of microphone assembly 14 towards the user mouth in the dangle position allows for better isolation from the earbud 12 signal and improved signal to noise ratio. In an embodiment of the invention, distance D is approximately between 9 and 11 cm. Communications headset assembly 10 can be used in a hands-free operation mode with microphone assembly 14 in the dangle position.

Figure 4:
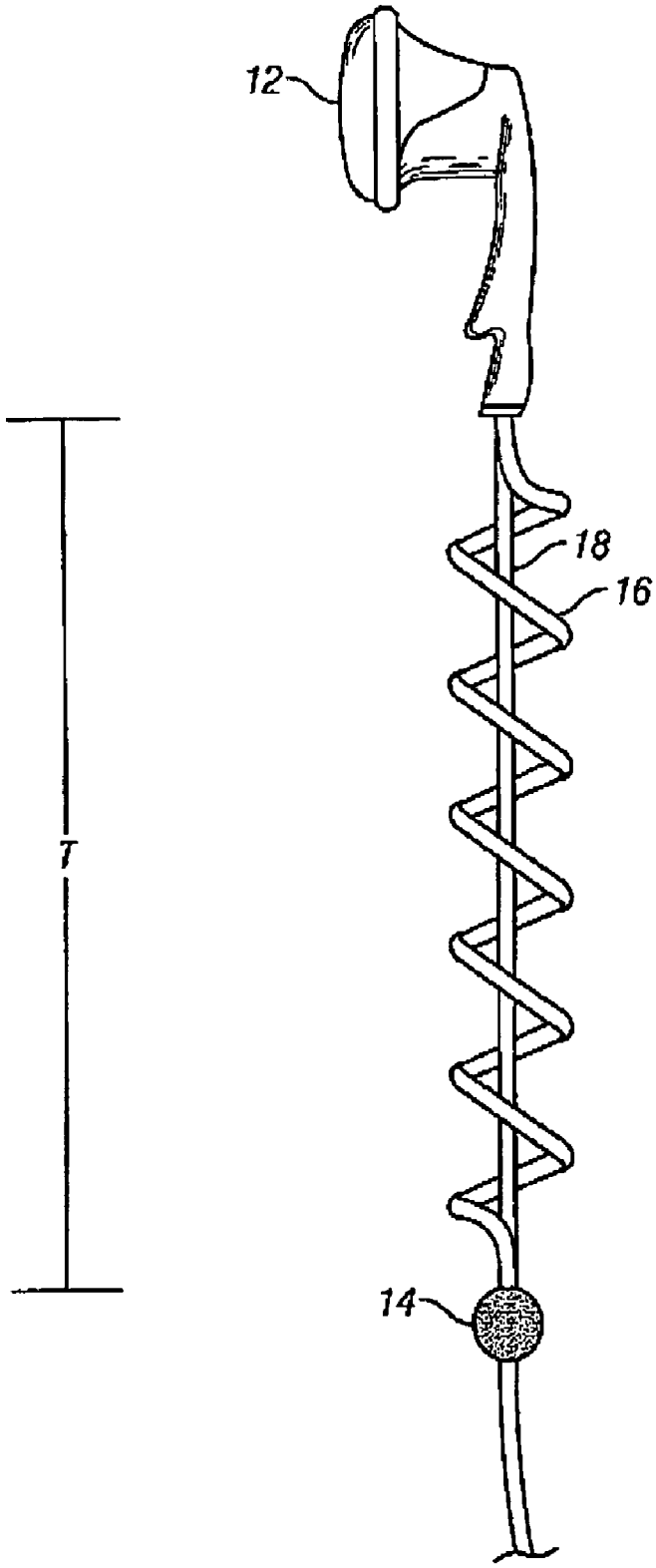
FIG. 4 illustrates a side view of the communications headset of the present invention in an extended position.

The operation of the communications headset assembly 10 in a hand-operated mode will now be described. Referring to FIG. 4, a side view of the communications headset is shown with the microphone assembly 14 in an extended position. In operation, microphone assembly 14 is advanced down electrical cord 18 via extension of spring cord 16 responsive to a user's physical hand adjustment. Microphone assembly 14 is extended a distance T down electrical cord 18, where distance T is equal to distance D plus the distance the user has extended spring cord 16. In the extended position, isolation from the earbud 12, echo reduction, and signal to noise ratio are improved relative to the dangle position. In an embodiment of the invention, the distance T is approximately between 19 and 21 cm. When a user switches from a hand-operated to a hands-free mode, microphone assembly 14 automatically retracts to the dangle position as a result of a retraction force exerted by spring cord 16. By this arrangement, the invention allows the desired microphone assembly 14 placement during hands free operation.

Having described the invention in terms of a preferred embodiment, it will be recognized by those skilled in the art that various types of components may be substituted for the configuration described above to achieve an equivalent result. For example, although the communications headset assembly is described utilizing an in the ear device wherein the earbud sits in the ear of a user, other receivers and associated headset supporting structures such as over the ear configurations or behind the ear configurations can also be employed as contemplated by the invention.

Furthermore, the lengths, shapes and materials of the components, including the earpiece, spring cord, electrical cord, and mating connectors, described herein can vary. The function of the spring cord as a spring and cord as described herein may be implemented utilizing separate structures. For example, a standard extension spring may be used to perform the associated spring functions of extension and retraction together with a separate cord to electrically couple the microphone to the earbud. It will be apparent to those skilled in the art that modifications and variations of the described embodiments are possible, and that other elements or methods may be used to perform equivalent functions, all of which fall within the true spirit and scope of the invention as measured by the following claims.

The invention claimed is:

1. A communications headset comprising:

an earbud with a speaker to be disposed near the ear of a headset user;

a microphone;

an electrical connector designed to couple with a communications device;

an electrical cord with a first end coupled to the earbud and a second end coupled to the electrical connector; and a spring cord physically distinct from the electrical cord with a first end coupled to the earbud and a second end coupled to the microphone, wherein the microphone is capable of bi-directional movement with associated extension and retraction of the spring cord.

2. The communications headset of claim 1, wherein the electrical cord is disposed within the spring cord.

3. The communications headset of claim 2, wherein the bidirectional movement of the microphone is along an axis defined by the electrical cord.

4. The communications headset of claim 2, wherein the microphone is positioned by gravity away from the earbud by extending the spring cord.

5. The communications headset of claim 2, wherein the microphone is positioned by a user away from the earbud by extending the spring cord, and wherein the microphone is automatically returned towards the earbud upon release by the user for hands free operation or headset storage.

6. The communications headset of claim 1, further comprising a cord retractor along the electrical cord between the earbud and electrical connector for retracting the electrical cord.

7. The communications headset of claim 6, wherein the cord retractor is an uptake cord storage reel.

8. A communications headset comprising:

an earbud with a speaker to be disposed near the ear of a headset user;

a microphone;

an electrical connector designed to couple with a communications device;

an electrical cord with a first end coupled to the earbud and a second end coupled to the electrical connector; and a spring cord physically distinct from the electrical cord with a first end coupled to the earbud and a second end coupled to the microphone, wherein the electrical cord is disposed within the spring cord and the relative position of the microphone along the electrical cord defines a plurality of microphone positions comprising:

a storage position associated with the spring cord in a retracted status;

a first use position for hands free operation whereby the spring cord is in a first extended position due to the weight of the microphone; and a second use position for improved signal to noise ratio whereby the spring cord is in a second extended position due to user applied force.

9. The communications headset of claim 8, further comprising a cord retractor disposed between the connector and earbud, wherein the cord retractor winds the electrical cord between the connector and earbud when the microphone is in the storage position.

10. The communications headset of claim 9, wherein the cord retractor is an uptake cord storage reel.

11. The communications headset of claim 8, wherein a spring cord retraction force automatically returns the microphone from the second use position to the first use position upon termination of the user applied force.

12. The communications headset of claim 8, wherein the distance of electrical cord between the corresponding microphone position and earbud is 9–11 centimeters in the first use position.

13. The communications headset of claim 8, wherein the distance of electrical cord between the corresponding microphone position and earbud is 19–21 centimeters in the second use position.

14. A communications headset comprising:

a speaker means for outputting receive voice signals from a far end user;

a microphone means for detecting transmit voice signals from a headset user;

a connector means for coupling the headset to a communications device;

a cord means with a first end coupled to the speaker means and a second end coupled to the connector means; and a spring cord means physically distinct from the cord means with a fist end coupled to the speaker means and a second end coupled to the microphone means, wherein the microphone means is capable of bi-directional movement with associated extension and retraction of the spring cord means.

15. The communications headset of claim 14, further comprising a retractor means disposed between the speaker means and connector means for storing the cord means.

16. A method for improving signal to noise ratio in a communications headset comprising:

providing an earbud, a microphone, a connector, an electrical cord with a first end coupled to the earbud and a second end coupled to the electrical connector, and a spring cord physically distinct from the electrical cord with a first end coupled to the earbud and a second end coupled to the microphone, wherein the electrical cord is disposed in the spring cord;

positioning the microphone along the electrical cord away from the earbud with a user applied force, wherein signal to noise ration is improved; and automatically retracting the microphone along the electrical cord towards the earbud upon termination of the user applied force, wherein the spring cord provides the retraction force to position the microphone for hands free operation.

* * * * *